United States Patent [19]

Hughes

[11] 4,175,819

[45] Nov. 27, 1979

[54] CONNECTING MEANS FOR CONNECTING COIL WIRES TO LEAD WIRES

[75] Inventor: Donald W. K. Hughes, Mechanicsburg, Pa.

[73] Assignee: AMP Incorporated, Harrisburg, Pa.

[21] Appl. No.: 925,502

[22] Filed: Jul. 17, 1978

[51] Int. Cl.[2] ..... H01R 13/02

[52] U.S. Cl. ..... 339/176 M

[58] Field of Search ..... 339/97 R, 97 P, 98, 339/276 SF, 278, 176 R, 176 M

[56] References Cited

U.S. PATENT DOCUMENTS

| | | | |
|---|---|---|---|
| 3,115,244 | 12/1963 | Laskowski | 339/276 SF |
| 4,023,883 | 5/1977 | Raposa et al. | 339/98 |
| 4,038,573 | 7/1977 | Hillyer et al. | 310/71 |

*Primary Examiner*—Joseph H. McGlynn

*Attorney, Agent, or Firm*—Frederick W. Raring

[57] ABSTRACT

Electrical connecting means for connecting a relatively fine coil wire to a lead wire comprises an insulating housing having first and second terminal receiving cavities therein and a terminal device comprising first and second contact terminals connected by a deformable section. Both of the terminals have contacting means thereon which establish contact with the wires when they are inserted into the cavities. In use, the coil wire is placed in the second cavity, the second terminal device is inserted into the second cavity and contact is established with the coil wire. Thereafter, the lead wire is positioned in the first cavity, the connecting section of the terminal device is bent, and the first terminal inserted into the first cavity to establish electrical contact with the first wire.

8 Claims, 10 Drawing Figures

CONNECTING MEANS FOR CONNECTING COIL WIRES TO LEAD WIRES

BACKGROUND OF THE INVENTION

This invention relates to electrical connecting means for making electrical connections between relatively fine coil wires and lead wires extending from a coil.

In the manufacture of electrical devices such as motor stators and induction coils, it is necessary to connect the ends of the coil wire to lead wires which extend from the coil. The coil wires are frequently relatively fine gage and the lead wires are often relatively coarse as compared to the coil wires. In many manufacturing processes, the coil is wound on the bobbin or on a motor stator by an automatic winding machine and at the conclusion of the winding operation, the ends of the coil wire are connected to electrical terminals mounted in a housing adjacent to the winding. At a later stage in the manufacturing operation, the lead wires are connected to the same terminals. U.S. Pat. Nos. 3,725,707; 3,979,615; and 4,026,013 show several types of connecting means for making these electrical connections to coil wires on induction coil bobbins and coils wound on motor stators.

The present invention is directed to the achievement of an improved connecting means for coil wire-lead wire connections which can be used on relatively small induction coil wires and relatively coarse lead wires. The connecting means comprises an insulated housing having first and second terminal-receiving cavities extending therein and a double-ended terminal device having first and second contact terminals at its ends. The second cavity has locating means for the coil wire so that the coil wire can be positioned in the second cavity and, upon insertion of the second terminal into the cavity, contact is established with the coil wire and the terminal device will be firmly held on the housing. Thereafter, the lead wire is inserted into the first cavity and the terminal device is bent in a manner such that a first terminal enters the first cavity and establishes electrical contact with the lead wire. After insertion of the first terminal into the first cavity, the terminal device will be recessed below the surface of the first cavity and the electrical connections will be contained in the cavities and protected from the atmosphere and from physical damage.

The connecting means, including the terminal device, are compatible with standard manufacturing process for manufacturing small coils, in that after the coil has been wound on a bobbin, the terminal devices can be connected to the ends of the coil wire by inserting the second contact terminals into the second cavities. At that stage of the manufacturing process, the electrical connections to the coil wires will have been established and at the subsequent stage of the manufacturing process, the lead wires can be connected to the terminal devices, and therefore to the ends of the coil wire, by inserting the ends of the lead wires into the first cavities, as explained above. In the interim, between the insertion of the second terminals into the second cavities and the insertion of the lead wires into the first cavities and bending of the terminal, the bobbin with the coil wound thereon can be handled and transported without danger of damage to the electrical connections. The invention is also directed to improved strain relief means for the lead wires so that the electrical connections of the lead wires to the terminals will not be damaged upon flexing of the lead wires.

A preferred embodiment of the invention is described below and is illustrated in the accompanying drawing in which:

FIG. 3 is a fragmentary top plan view of the connector housing in accordance with the invention showing adjacent portions of the flange of the bobbin.

Figure 4:
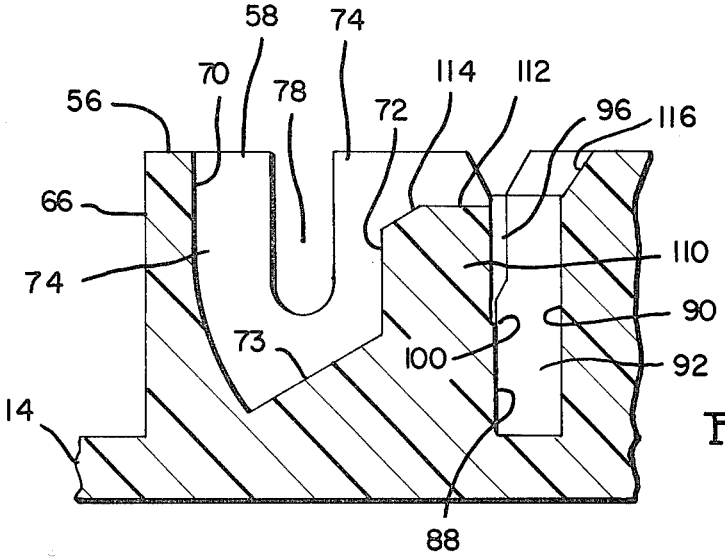
Figure 6:
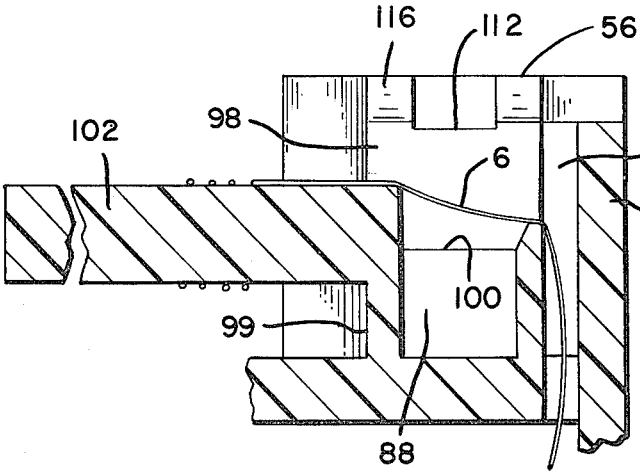
Figure 5:
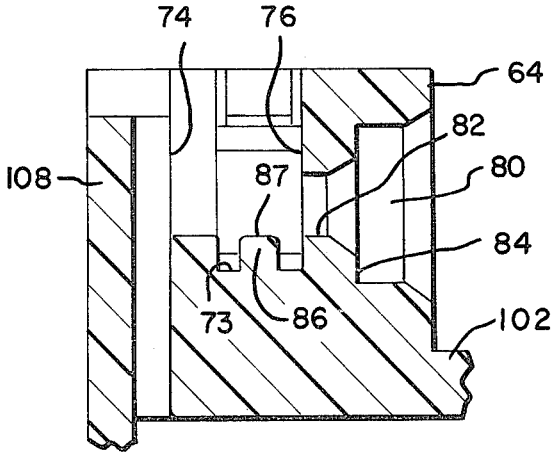
Figure 7:
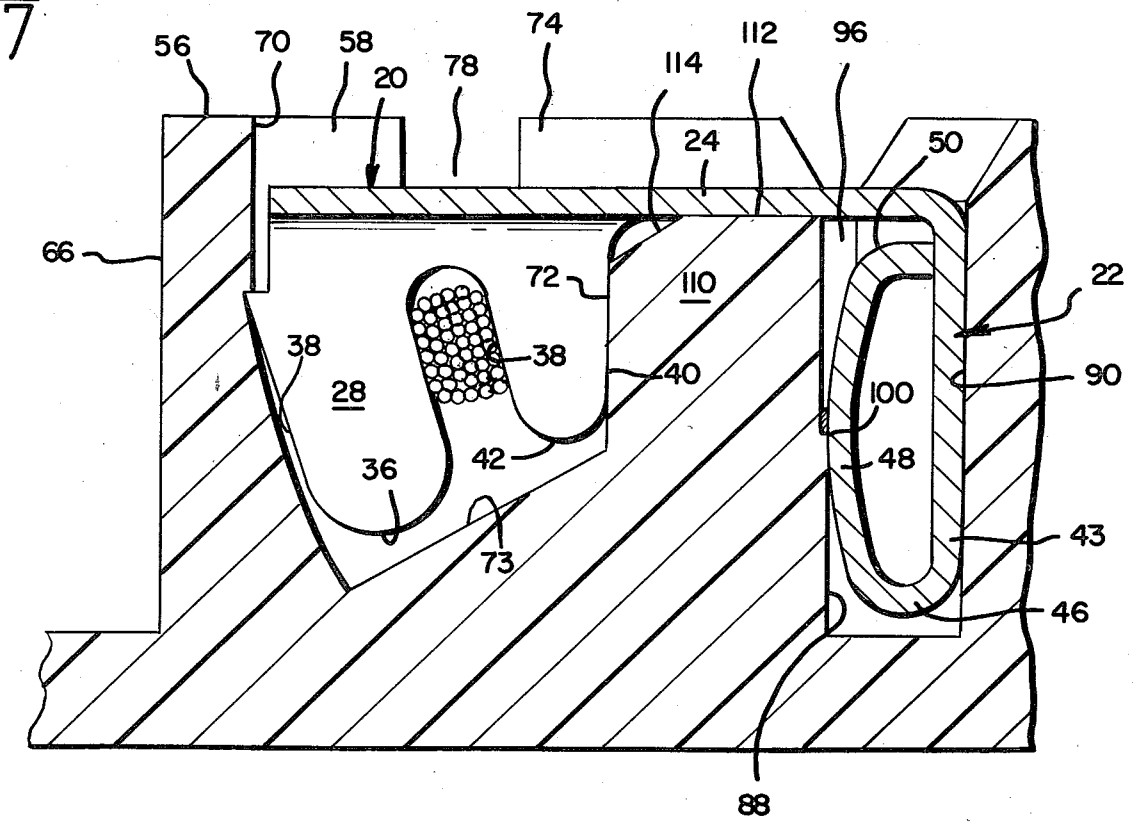

FIGS. 4, 5, and 6 are views taken along the lines 4—4, 5—5 and 6—6 of FIG. 3.

Figure 7:
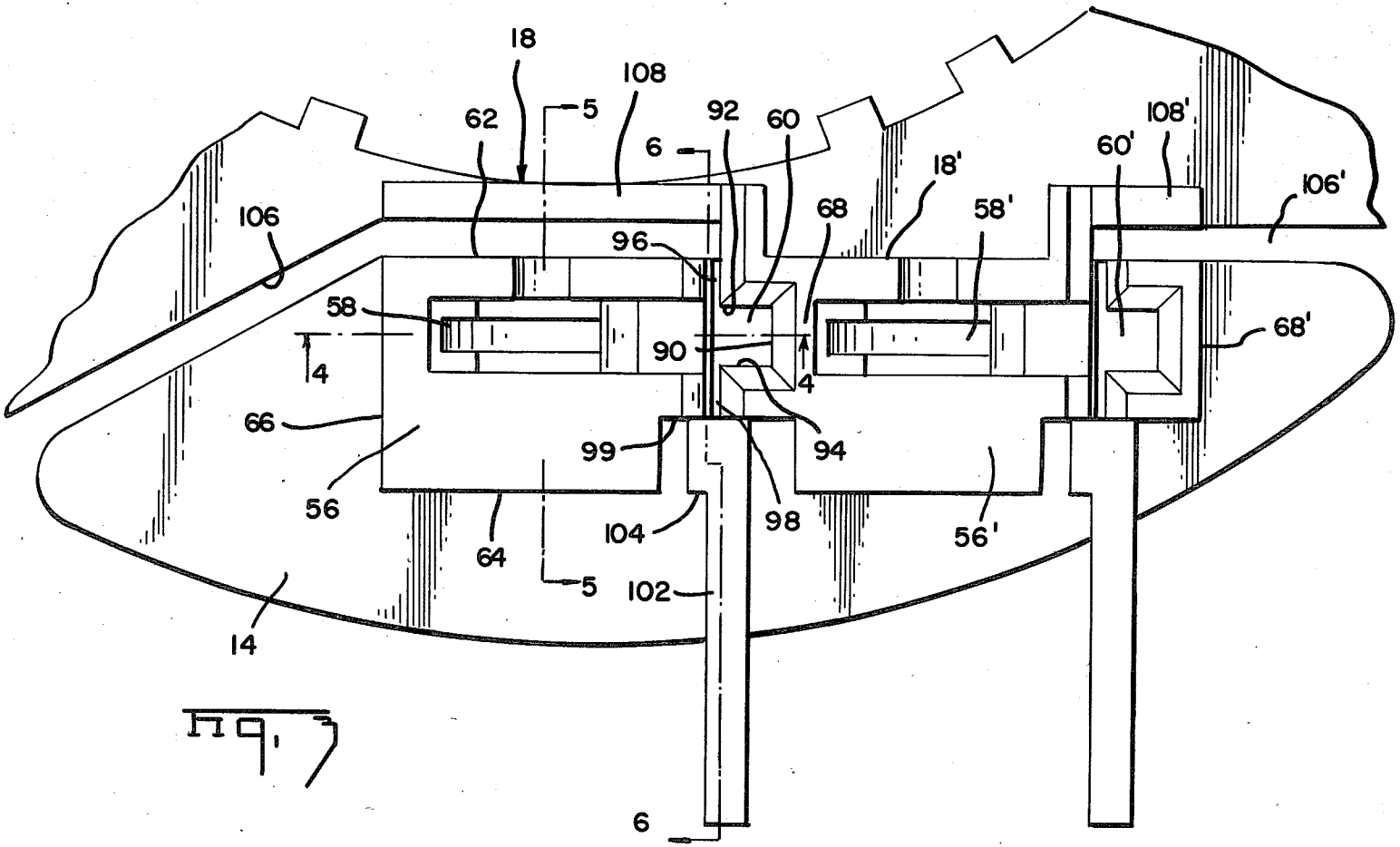

FIG. 7 is a view similar to FIG. 4 but showing terminal device positioned in the first and second cavities of the connecting means.

Figure 8:
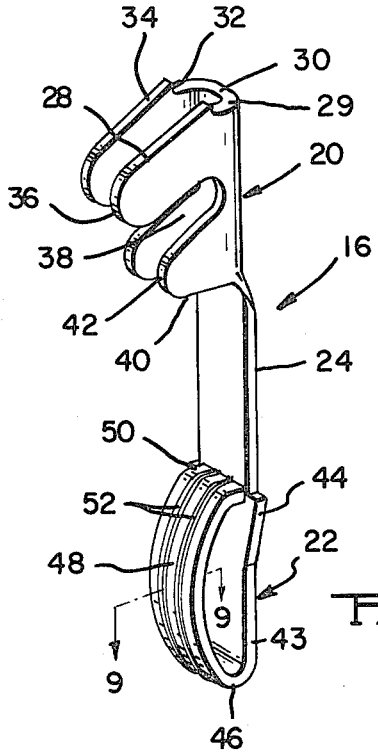

FIG. 8 is a perspective view of the terminal device.

Figure 9:
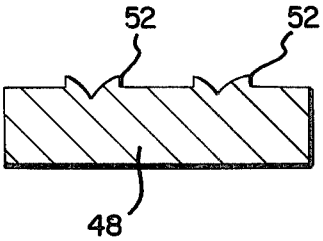

FIG. 9 is a view taken along the lines of 9—9 of FIG. 8.

Figure 10:
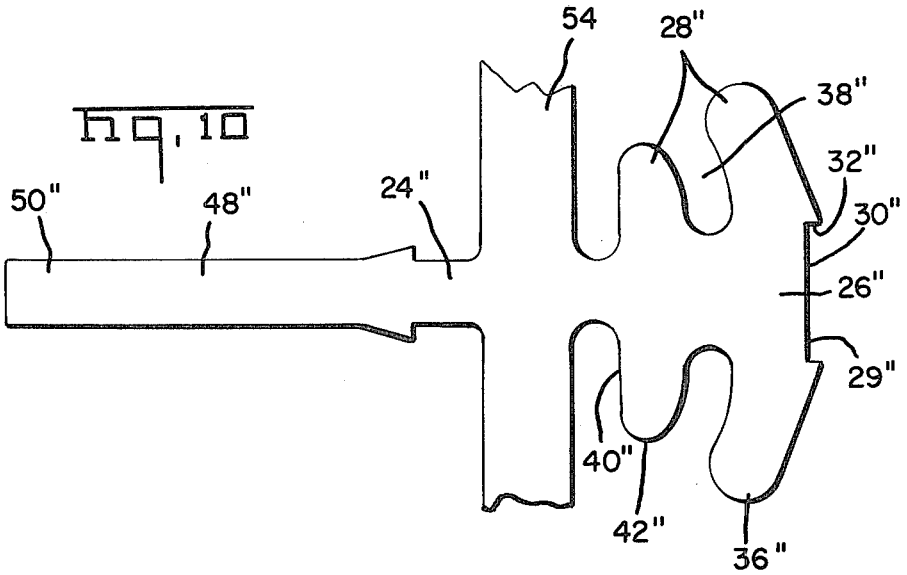

FIG. 10 is a plan view of the flat blank from which the terminal device is formed.

Figure 1:
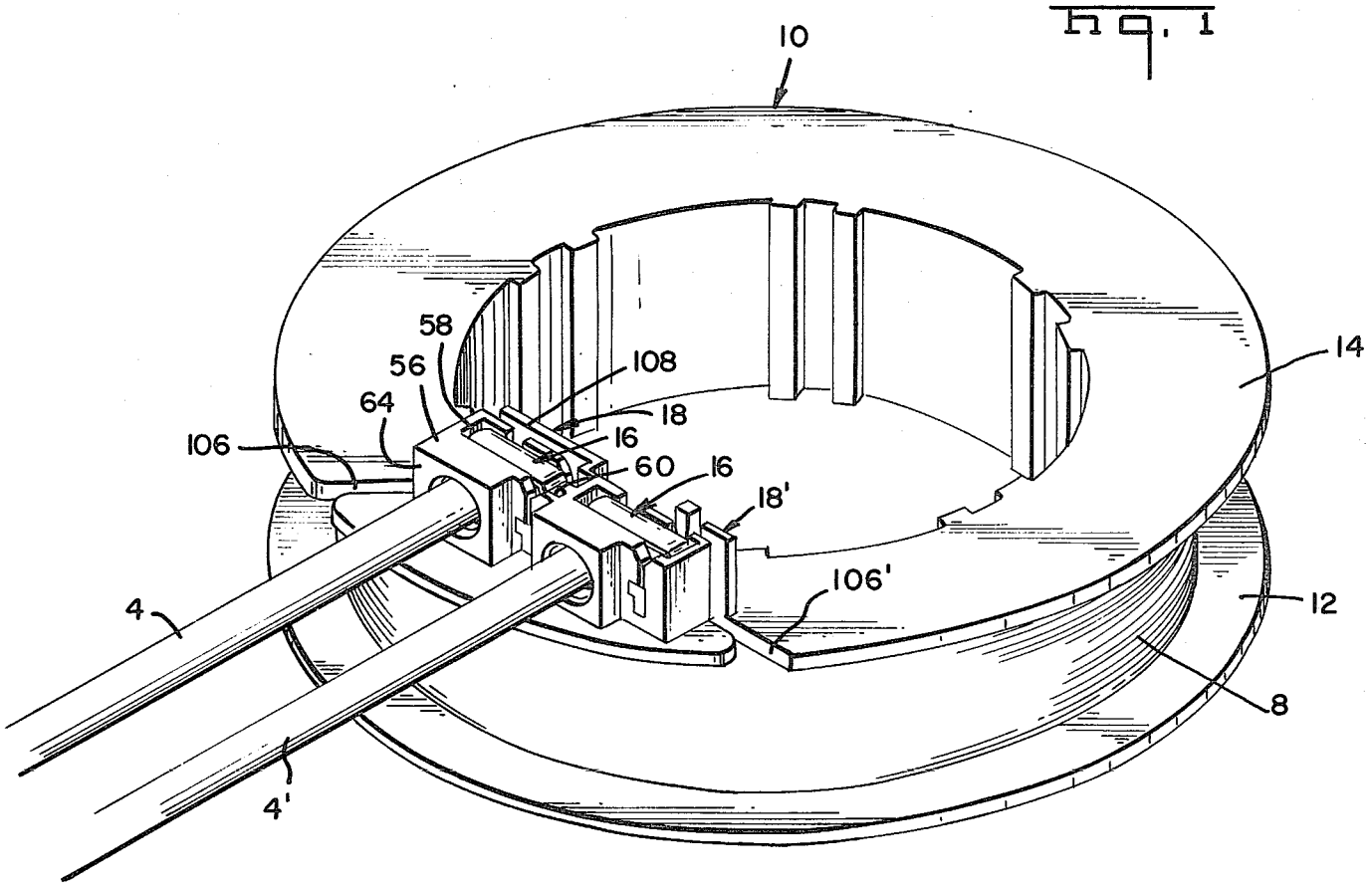
FIG. 1 is a perspective view of a coil bobbin having connecting means in accordance with the invention thereon and with the ends of the coil wire connected to lead wires.

FIG. 1 shows a coil bobbin 10 which is of relatively firm insulating material such as glass filled molded nylon having an electrical coil 8 wound thereon with the ends 6, 6' of the coil wire being connected to the stripped ends 2, 2' of lead wires 4, 4'. The bobbin has flanges 12, 14 on each side of the coil supporting cylindrical surface and the electrical connections between the ends of the coil wire and the lead wire are contained in housings 18, 18' which are integral with the flange 14.

The electrical connections are made by means of double-ended terminal devices 16, 16' shown in FIGS. 8–10, one terminal being required for each lead wire and coil wire connection. Since the terminals and the housings are substantially identical, the same reference numerals, differentiated by prime marks, will be used for both sets of terminals and housings and the terminal and housing on the left will be described in detail.

The terminal device 16 comprises first and second contact terminals 20, 22 which are connected to each other by a deformable connecting neck 24. The first terminal 20 is generally U-shaped and comprises a flat web 26 and parallel sidewalls 28 extending from the side edge portions of the web. Each sidewall 28 has an outer edge 29 which extends from the upper free end 30 of the web laterally to a shoulder 32 and an adjoining edge portion 34 which extends diagonally to a rounded outer free end 36. A second edge 40 which is spaced from the free end 30 extends normally from the web to a rounded outer end 42'. A wire-receiving slot 38 extends arcuately into the sidewall between the outer end portions 36, 42.

The connecting neck section 24 is coplanar with the web 26 of the first terminal and has outwardly extending barbs 44 on its side edges adjacent to the second contact terminal 22.

The second terminal comprises a flat extension of the web 43 which is reversely bent at 46 to provide an arcuate spring section 48 which extends away from, and then back towards, the connecting section 24. The end of the section 48 is abruptly inwardly formed as shown at 50 so that it bears against the surface of the section 43 as shown in FIG. 8.

As will be explained below, the outwardly facing surface of the spring section 48 moves relatively past the end of the coil wire 6 and penetrates the insulation of the wire to establish contact therewith. Penetration of the varnish-type film on the wire is achieved by sharp peaks 52 formed by indenting the surfaces of the spring section 48. It should be explained that for purposes of the present invention, any desired type of contact terminal device can be used for the terminal 22 which will establish contact with the coil wire upon movement of the terminal 22 into a cavity.

Contact terminals of the type shown at 16 are advantageously manufactured in the form of a continuous strip with each terminal device being integral with a continuous carrier strip 54 as shown in FIG. 10. FIG. 10 shows the flat blank from which the finished terminal is formed with the parts of the blank being identified with the same reference numerals, differentiated by double prime marks, as are used in FIG. 8. A continuous strip of terminals can be fed to an automatic insertion machine which severs the leading terminal from the strip and inserts it into the second housing cavity 60 described below. Suitable conductive spring material is used for the manufacture of the terminals such as a brass having spring properties.

The housings 18, 18' which receive the terminal device 16, 16' are disposed in side-by-side relationship on the upper surface of flange 14 and are separated by a common endwall 68, FIG. 3. The housing 18 has an upwardly facing terminal-receiving face 56 and first and second terminal-receiving cavities 58, 60 extending into the terminal-receiving face. The terminal-receiving face is surrounded by a sidewall 62 which faces inwardly towards the center of the bobbin 10, an outwardly facing or wire-admitting sidewall 64, an endwall 66 and previously identified wall 68 which is common to both of the housings. The first cavity has opposed internal endwalls 70, 72, the endwall 70 being proximate to the external endwall 66. The lower portion of this endwall slopes arcuately towards the floor 73 of the cavity, the curvature being sufficient to accommodate the arcuate edges of the terminal sidewalls 28 as shown in FIG. 7. The endwall 72 extends normally of the surface 56 and is dimensioned to accommodate the sidewalls of the terminal 20.

The cavity has internal sidewalls 74, 76, the sidewall 76 being proximate to the external sidewall 64. A wire-admitting opening 80 extends through the sidewall 64 and communicates with the cavity as shown at 82. This wire-admitting opening has an outer portion which is dimensioned to receive the insulation on the lead wire 4 and an inner portion adjacent to the cavity which will admit only the stripped end 2 of the wire. The sidewall 74 has a slot 78 therein so that the stripped end 2 can be inserted entirely through the cavity so that its extreme end is positioned in slot 78. A wire supporting rib 86 extends between the endwalls 70, 72 and the upper surface 87 of this rib supports the wire at the level of the inner end of the slot 78 as will be apparent from FIG. 5.

The second cavity 60 has opposed internal endwalls 88, 90 and opposed front and back internal sidewalls 92, 94. A slot 96 is provided in the rear sidewall 92 in which the relatively fine coil wire is positioned and a similar slot 98 is provided in the sidewall 94. The slot 98 opens onto an inwardly offset portion 99 of the external sidewall 64 as best shown in FIG. 3. An extremely narrow ledge 100 extends across the end wall 88 at a level below, as viewed in FIG. 4, the lower ends of the slots 96, 98. Ledge 100 cooperates with the terminal device 22 when the second terminal device is inserted into the cavity to establish contact with the wire as will be described below. A severable binding post 102 extends forwardly from the inwardly offset portion 99 of a sidewall 64 and is of reduced width as shown at 104 to provide a shoulder for retaining the fine wire when it is wound thereon.

Figure 2:
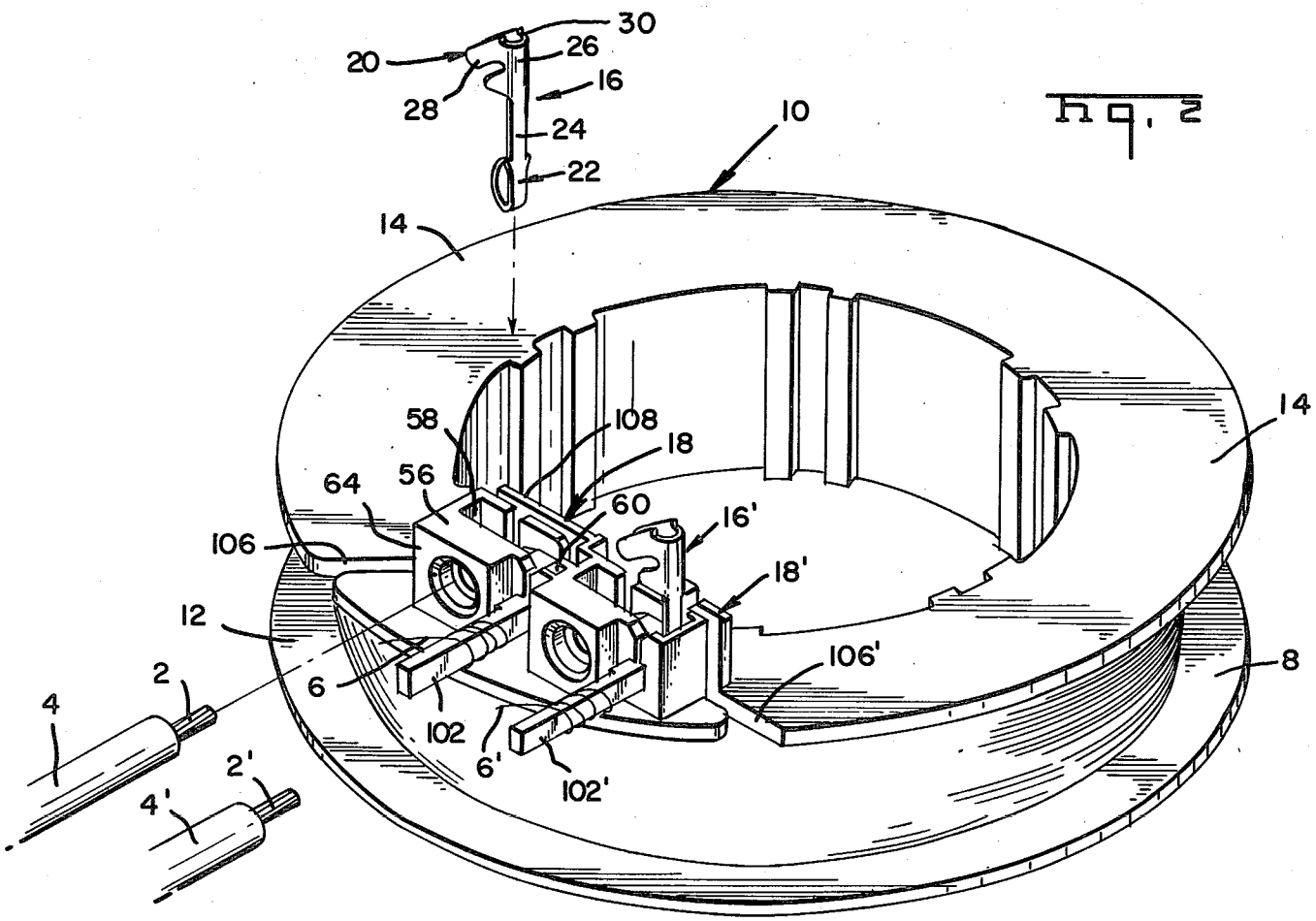
FIG. 2 is a view similar to FIG. 1 but showing the lead wires exploded from the connector housing and one of the terminal devices exploded from the connector housing.

The end of the coil wire is positioned in the second cavity by threading it through a slot 106 in the flange 14, FIGS. 2 and 3. The inner end of the slot communicates with a confined passageway which is between the sidewall 62 and a barrier wall 108 which extends from the surface of the flange 14. The right hand end (as viewed in FIG. 3) of this confined passageway communicates with the previously identified slot 96.

The first and second cavities are separated by a separator wall 110, the upper surface of which 112 is recessed below the terminal-receiving surface 56 of the housing. This upper surface is inclined downwardly as shown at 114 to facilitate complete insertion of the first terminal 20 into the first cavity 58. Inclined surfaces as shown at 116 are provided at the upper end of the first cavity to guide the first terminal into the first cavity.

As previously mentioned, the first and second cavities 58, 60 of the two housings are substantially identical, however, the external sidewall 62' and the barrier wall 108' of the second housing differ from the corresponding sidewall and barrier wall 62, 108 of the first housing 18. These differences are simply a result of the orientation of the housings on the flange.

In use, at the time the coil 8 is wound on the bobbin, the ends 6, 6' of the coil wires are laced through the slots 106, 106' and are placed in the wire-admitting slots 96, 98 of the second cavities. The ends of the wires are then wrapped around the end portions of the binding posts 102, 102' as shown in FIG. 2. The second terminals 22, 22' are then inserted into the second cavities of the two housings and upon movement of these terminals into the cavities, the sharp ridges 52 of the terminals penetrate the insulation of the wires and establish electrical contact. During insertion of the terminal devices, the binding posts 102, 102' are sheared from the housings and the wires are sheared at the same time, the cut ends of the wires being drawn into the cavities as the terminals move to their fully inserted positions. The shoulders 100, 100' support the wires during insertion of the terminals.

After insertion of the second terminals 22, 22', the connecting sections 24 and the first terminals 20 will extend upwardly beyond the terminal-receiving face 56 of the housings as shown in FIG. 2. When the lead wires 4, 4' are to be connected to the coil wires, the stripped ends 2, 2' are inserted into the wire-admitting openings 80, 80' until the end of the insulation is against the shoulders 84 and the stripped ends extend through the first cavities and into the slots 78, 78'. Thereafter the first terminals 20, 20' are inserted into the first cavities by simply bending the connecting sections 24 of the terminals as shown in FIG. 7. As the sidewalls 28, 28' of the first terminals move into the first cavities, the stripped ends of the wires will be received in the slots 38, 38' of the terminals and the opposed edges of the slots will establish electrical contact with the lead wires.

In a typical coil manufacturing process, the terminals 22, 22' will be inserted into the housings immediately after winding of the coil on the bobbin and at a subsequent step in the manufacturing process, the lead wires will be connected to the terminals. The bobbin can be handled and transported without fear of damage to the electrical connections to the coil wires after the terminals 22, 22' have been inserted.

The specific connecting device 22 on the lower end of the terminal device 16 is described more fully in co-pending application Ser. No. 925,503. It will be understood that other types of terminals might be used in place of the terminal 22, for example, a conventional slotted plate-type device as shown in one of the patents cited above. In any event, the terminal on the lower end of the terminal device 16, that is the second terminal, should have a force fit in the second cavity so that the terminal device 16 will be firmly held in the housing.

The terminals can be produced of any suitable conductive metal, such as a work hardened brass, which has acceptable spring properties. The bobbin and housings should be of a thermoplastic material which is sufficiently firm to ensure stability in the electrical connections to the fine wire. As noted above, nylon containing 15% to 33% glass fibers is entirely suitable.

By virtue of the fact that the lead wires extend into the circular openings 80 and also by virtue of the fact that the inner ends of the slots 38 and the supporting surface 87 confine the stripped end of the lead wire, a very effective strain relief means is provided for the lead wires. Flexure of the lead wires in any direction adjacent to the housing does not interfere with the effectiveness of the electrical connections between the stripped ends of the terminal wires and the terminals.

I claim:

1. Electrical connecting means for connecting a first wire to a second wire, said connecting means comprising:

an insulating housing having a terminal-receiving face and having first and second terminal-receiving cavities extending into said terminal-receiving face, sidewalls and endwalls surrounding said terminal-receiving face, one of said sidewalls constituting a first wire-admitting sidewall, a first wire-admitting opening in said first wire-admitting sidewall communicating with said first cavity, first wire-supporting means in said first cavity for supporting said first wire upon placement of said first wire in said opening with its axis extending transversely across said first cavity, a second wire-admitting opening in one of said sidewalls communicating with said second cavity, means in said second cavity for supporting said second wire upon placement of said second wire in said second wire-admitting opening, terminal means comprising first and second contact terminals which are connected to each other by a deformable connecting neck, said second terminal being dimensioned to have a force fit in said second cavity and having contact means thereon for establishing electrical contact with a second wire disposed in said second cavity upon insertion of said second terminal into said second cavity, said first terminal being insertable into said first cavity with accompanying bending of said connecting neck after insertion of said second terminal into said second cavity, said first terminal having a first wire-receiving portion which is dimensioned to receive and establish electrical contact with said first wire upon movement of said wire-receiving portion past said first wire whereby, upon placement of said second wire in said second cavity, and insertion of said second contact terminal into said second cavity, said second wire will be placed in electrical contact with said second terminal and said terminal means will be securely held on said housing, and upon subsequent placement of said first wire in said first wire-admitting opening and in said first cavity, and upon movement of said first terminal into said first cavity with accompanying deformation of said connecting neck, said first wire will be received by said wire-receiving portion of said first terminal whereby said first wire is connected to said second wire.

2. Electrical connecting means as set forth in claim 1, said first terminal comprising at least one plate-like member having a leading edge which enters said first cavity first, said first wire-receiving portion comprising a wire-receiving slot extending into said plate-like member from said leading edge whereby, upon movement of said first terminal into said first cavity, said lead wire is received in said slot and the edges of said slot establish electrical contact with said lead wire.

3. Electrical connecting means as set forth in claim 1, said first terminal being U-shaped and comprising a web and sidewalls extending from said web, said connecting neck being an extension of said web, said first terminal having a free end which is remote from said connecting neck, each of said sidewalls having one edge which is spaced from said free end and another edge which extends arcuately from said free end towards said one edge, said first wire-receiving portion of said first terminal comprising wire-receiving tabs extending arcuately from said first edges of said sidewalls and parallel to said second edges, said first terminal being movable into said first cavity along an arcuate path.

4. Electrical connecting means as set forth in claim 1, said housing having a separator wall between said first and second terminal-receiving cavities, said separator wall having a surface extending between said first and second cavities which is recessed from said terminal-receiving face, portions of said housing between between said top surface of said separator wall and said terminal-receiving face being dimensioned to receive said deformable connecting neck upon movement of said first terminal into said first cavity.

5. Electrical connecting means as set forth in either one of claims 1 or 4, said terminal means comprising an elongated strip of conductive metal, said first terminal comprising end portions of said strip and sidewalls extending from marginal side edge portions, said first wire-receiving portion comprising aligned wire-receiving slots in said sidewalls.

6. Electrical connecting means as set forth in claim 5, said first terminal being dimensioned to be inserted into said first cavity by movement of said first terminal along an arcuate path, said wire-receiving slots in said sidewalls extending arcuately.

7. Electrical connecting means as set forth in claim 6, said housing being integral with a bobbin having a coil wound thereon, said connecting means being intended for connecting the ends of said coil to lead wires.

8. Electrical connecting means as set forth in claim 6, said first wire-admitting opening in said first wire-admitting sidewall comprising a circular opening.

* * * * *